US006837315B2

(12) United States Patent
Pisoni et al.

(10) Patent No.: US 6,837,315 B2
(45) Date of Patent: Jan. 4, 2005

(54) ROTARY STEERABLE DRILLING TOOL

(75) Inventors: Attilio C. Pisoni, Stonehouse Glos (GB); Ruben Martinez, Cheltenham (GB); Spyro Kotsonis, Le Plessis Robinson (FR); Stuart Schaaf, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/122,108

(22) Filed: Apr. 12, 2002

(65) Prior Publication Data

US 2002/0175003 A1 Nov. 28, 2002

Related U.S. Application Data

(60) Provisional application No. 60/289,771, filed on May 9, 2001.

(51) Int. Cl.[7] ..... E21B 7/04; F16D 3/66

(52) U.S. Cl. ..... 175/61; 175/74; 175/269; 464/158; 464/159

(58) Field of Search ..... 175/61, 73, 27, 175/74, 250, 62, 269, 317, 324; 464/112, 158, 159, 147, 160

(56) References Cited

U.S. PATENT DOCUMENTS

| | | | | |
|---|---|---|---|---|
| 3,992,119 A | * | 11/1976 | Recker | 403/316 |
| 5,195,754 A | | 3/1993 | Dietle | |
| 5,358,445 A | * | 10/1994 | Wuebker | 464/112 |
| 5,423,389 A | * | 6/1995 | Warren et al. | 175/75 |
| 5,484,029 A | | 1/1996 | Eddison | |
| 5,617,926 A | * | 4/1997 | Eddison et al. | 175/61 |
| 6,047,784 A | | 4/2000 | Dorel | |
| 6,092,610 A | | 7/2000 | Kosmala et al. | |
| 6,109,372 A | | 8/2000 | Dorel et al. | |
| 6,158,529 A | | 12/2000 | Dorel | |
| 6,206,108 B1 | | 3/2001 | MacDonald et al. | |
| 6,244,361 B1 | * | 6/2001 | Comeau et al. | 175/61 |
| 6,415,878 B1 | * | 7/2002 | Cargill et al. | 175/61 |
| 6,733,393 B2 | * | 5/2004 | Rivin | 464/62 |

FOREIGN PATENT DOCUMENTS

| | | |
|---|---|---|
| EP | 0 763 647 A3 | 12/1998 |
| EP | 1 008 717 A1 | 6/2000 |
| EP | 0 763 647 B1 | 3/2001 |
| WO | WO 00/57018 | 9/2000 |

OTHER PUBLICATIONS

S. Schaaf, D. Pafitis & E. Guichemerre, "Application of a Point the Bit Rotary Steerable System in Directional Drilling Prototype Well–bore Profiles," *SPE 62519*, pp. 1–7, Prepared for presentation at the SPE/AAPG Western Regional Meeting, Long Beach, CA (Jun. 19–23, 2000).

S. Schaaf, CR Mallary & D. Pafitis, "Point–the–Bit Steerable System: Theory and Field Results," *SPE 63247*, pp. 1–9, Prepared for presentation at the 2000 SPE Annual Technical Conf. And Exh., Dallas, TX (Oct. 1–4, 2000).

S. Schaaf & D. Pafitis, "Field Applcaiton of a Fully Rotating Point–the–Bit Rotary Steerable System," *SPE/IADC 67716*, pp. 1–9, Prepared for presentation at the SPE/IADC Drilling Conf., Amsterdam, The Netherlands (Feb. 27–Mar. 1, 2001).

* cited by examiner

*Primary Examiner*—Frank Tsay
(74) *Attorney, Agent, or Firm*—Brigitte L. Echols; John Ryberg

(57) ABSTRACT

The invention refers to a rotary steerable drilling tool having a tool collar and a bit shaft. The bit shaft is supported within the tool collar for pivotal movement about a fixed position along the bit shaft. Moreover, the rotary steerable drilling tool includes a variable bit shaft angulating mechanism, located within the interior of the tool collar. The variable bit shaft angulating mechanism includes a motor, an offset mandrel, and a variable offset coupling. The motor is attached to the upper end of the offset mandrel and adapted to rotate the offset mandrel. The upper end of the variable offset coupling is uncoupleably attached to an offset location of the lower end of the offset mandrel, and the upper end of the bit shaft is rotatably coupled to the variable offset coupling. The rotary steerable drilling tool also includes a torque transmitting coupling adapted to transmit torque from the tool collar to the bit shaft at the fixed position along the bit shaft. Finally, a seal system is adapted to seal between the lower end of the tool collar and the bit shaft.

31 Claims, 7 Drawing Sheets

ROTARY STEERABLE DRILLING TOOL

CROSS-REFERENCE TO RELATED APPLICATIONS

This application claims priority from Provisional Application No. 60/289,771, filed May 9, 2001, the contents of which is hereby incorporated by reference in its entirety.

STATEMENT REGARDING FEDERALLY SPONSORED RESEARCH OR DEVELOPMENT

Not applicable.

BACKGROUND OF THE INVENTION

1. Field of the Invention

The invention relates generally to methods and apparatuses for the directional drilling of wells, particularly wells for the production of petroleum products. More specifically, it relates to a rotary steerable drilling tools and methods for drilling directional wells.

2. Background Art

It is known that when drilling oil and gas wells for the exploration and productions of hydrocarbons, it is often necessary to deviate the well off vertical and in a particular direction. This is called directional drilling. Directional drilling is used for increasing the drainage of a particular well by, for example, forming deviated branch bores from a primary borehole. Also it is useful in the marine environment, wherein a single offshore production platform can reach several hydrocarbon reservoirs, thanks to several deviated wells that spread out in any direction from the production platform.

Directional drilling systems usually fall within two categories: push-the-bit and point-the-bit systems, classified by their mode of operation. Push-the-bit systems operate by applying pressure to the side walls of the formation containing the well. Point-the-bit systems aim the drill bit to the desired direction therefore causing the deviation of the well as the bit drills the well's bottom.

Push-the-bit systems are well known and are described, for example, U.S. Pat. No. 6,206,108 issued to MacDonald et al. on Mar. 27, 2001, and International patent application no. PCT/GB00/00822 published on Sep. 28, 2000 by Weatherford/Lamb, Inc. These references describe steerable drilling systems that have a plurality of adjustable or expandable ribs or pads located around the corresponding tool collar. The drilling direction can be controlled by applying pressure on the well's sidewalls through the selective extension or retraction of the individual ribs or pads.

Point-the-bit systems are usually based on the principle that when two oppositely rotating shafts are united by a joint and form an angle different than zero, the second shaft will not orbit around the central rotational axis of the first shaft, provided that the two rates of rotation of both shafts are equal.

Various point-the-bit techniques have been developed which incorporate a method of achieving directional control by offsetting or pointing the bit in the desired direction as the tool rotates. One such point-the-bit technique is U.S. Pat. No. 6,092,610 issued to Kosmala et al. on Jul. 25, 2000, the entire contents of which is hereby incorporated by reference. This patent describes an actively controlled rotary steerable drilling system for directional drilling of wells having a tool collar rotated by a drill string during well drilling. The bit shaft is supported by a universal joint within the collar and rotatably driven by the collar. To achieve controlled steering of the rotating drill bit, orientation of the bit shaft relative to the tool collar is sensed and the bit shaft is maintained geostationary and selectively axially inclined relative to the tool collar during drill string rotation by rotating it about the universal joint by an offsetting mandrel that is rotated counter to collar rotation and at the same frequency of rotation. An electric motor provides rotation to the offsetting mandrel with respect to the tool collar and is servo-controlled by signal input from position sensing elements. When necessary, a brake is used to maintain the offsetting mandrel and the bit shaft axis geostationary. Alternatively, a turbine is connected to the offsetting mandrel to provide rotation to the offsetting mandrel with respect to the tool collar and a brake is used to servo-control the turbine by signal input from position sensors.

Despite the advancements of point-the-bit systems, there remains a need to develop rotary steerable drilling system which maximize the reliability and the responsiveness of the drilling apparatus. It is desirable for such a system to include, among others, one or more of the following: improved steering mechanisms, reduced number of seals, torque transmitting systems that transfers higher loads from the tool collar to the drill shaft, and improved sealing mechanisms. The system may include, among others, one or more of the following: a larger diameter motor preferably with a hollow rotor shaft through which drilling fluid is conducted, a motor with increased torque and heat dissipation, a flexible tube to conduct drilling mud through the center of the steering section of the tool, a universal joint that permits the transmission of higher loads, a bit bellow sealing system which seals the steering section oil environment while allowing angular motion of the bit shaft with respect to the collar, a variable bit shaft angle mechanism to allow the angle of the bit shaft to be varied while drilling and/or allows the tool to be adjusted to smoothly drill a wellbore with any curvature between a straight hole and a maximum curvature determined by the tool design, a bellows protector with a spherical interface such that a narrow gap may be maintained between the bit shaft and the collar to prevent debris from entering the tool. The present invention has been developed to achieve such a system.

SUMMARY OF THE INVENTION

An aspect of the invention is a rotary steerable drilling tool having a tool collar and a bit shaft. The bit shaft is supported within the tool collar for pivotal movement about a fixed position along the bit shaft. Moreover, the rotary steerable drilling tool includes a variable bit shaft angulating mechanism, located within the interior of the tool collar. The variable bit shaft angulating mechanism includes a motor, an offset mandrel, and a variable offset coupling. The motor is attached to the upper end of the offset mandrel and adapted to rotate the offset mandrel. The upper end of the variable offset coupling is uncoupleably attached to an offset location of the lower end of the offset mandrel, and the upper end of the bit shaft is rotatably coupled to the variable offset coupling. The rotary steerable drilling tool also includes a torque transmitting coupling adapted to transmit torque from the tool collar to the bit shaft at the fixed position along the bit shaft. Finally, a seal system is adapted to seal between the lower end of the tool collar and the bit shaft.

Another aspect of the invention is a variable bit shaft angulating mechanism that has a motor and an offset mandrel. The motor is attached at the upper end of the offset mandrel and adapted to rotate the offset mandrel. Moreover, the variable bit shaft angulating mechanism includes a variable offset coupling mechanism based on a lock ring, which is adapted to uncoupleably attach the upper end of the variable offset coupling at an offset location of the lower end of the offset mandrel.

Yet another aspect of the invention is a torque transmitting coupling that has a first shaft with protrusions extending from its periphery and a second shaft comprising an inner surface and a ring, the ring having an inner surface and a plurality of perforations around its perimeter and surrounding the first shaft, each protrusion being aligned with one perforation of the ring; and a plurality of cylinders comprising a lower end, the lower end having a slot; wherein the cylinders are located within the perforations of the ring and the protrusions enter the cylinder's slots.

Other aspects and advantages of the invention will be apparent from the following description and the appended claims.

DETAILED DESCRIPTION

Figure 1:
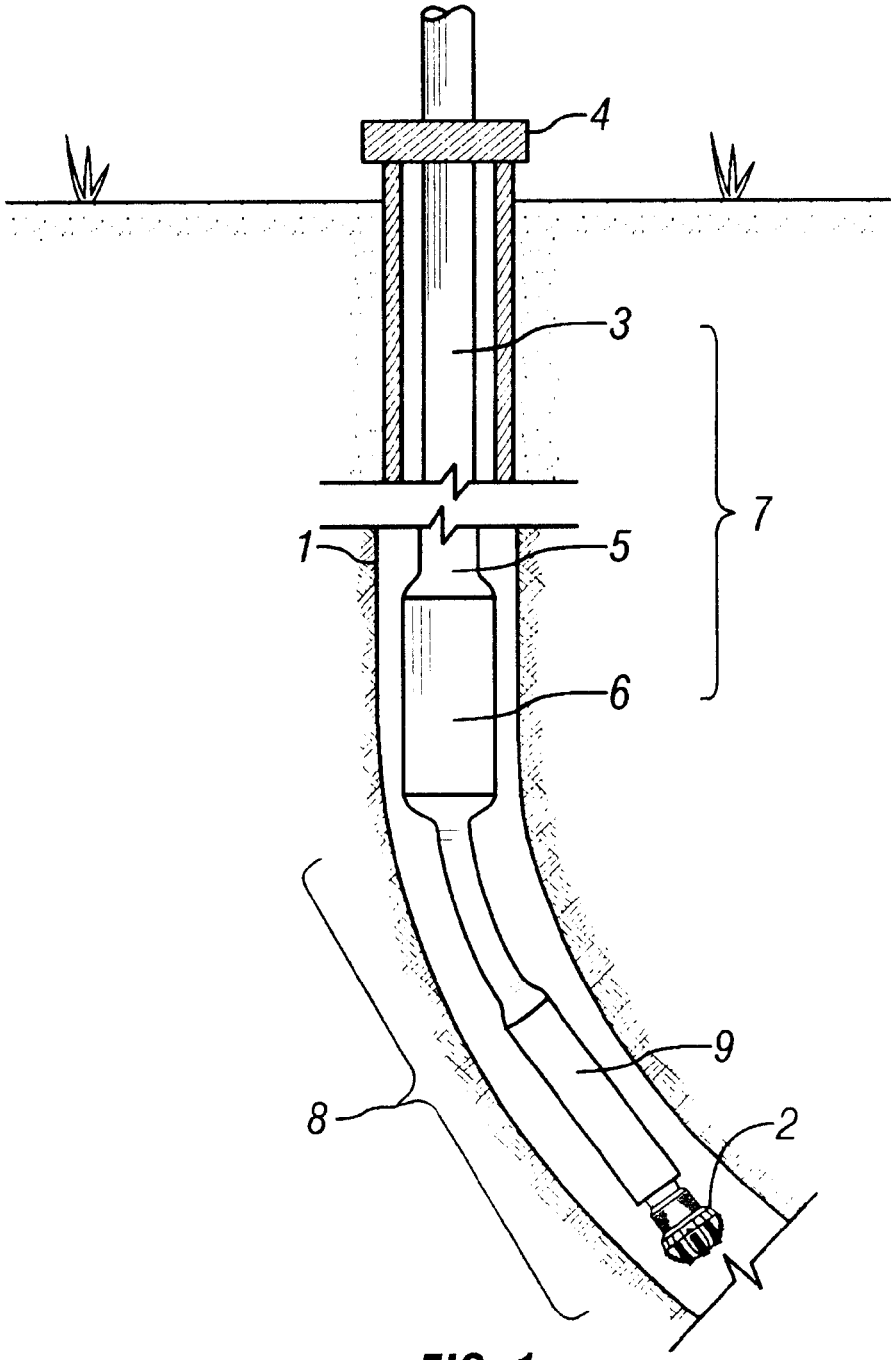
FIG. 1 is a schematic illustration of a well being drilled using a rotary steerable drilling tool in accordance to the instant patent application.

FIG. 1 shows a wellbore (1) that is being drilled by a rotary drill bit (2) that is connected to the lower end of a drill string (3) that extends upwardly to the surface where it is driven by a rotary table (4) of a typical drilling rig (not shown). The drill string (3) incorporates a drill pipe (5) having one or more drill collars (6) connected therein for the purpose of applying weight to the drill bit. The well bore is shown as having a vertical or substantially vertical upper portion (7) and a curved lower portion (8). The deviation of the well bore is made possible by rotary steerable drilling tool (9).

Figure 2:
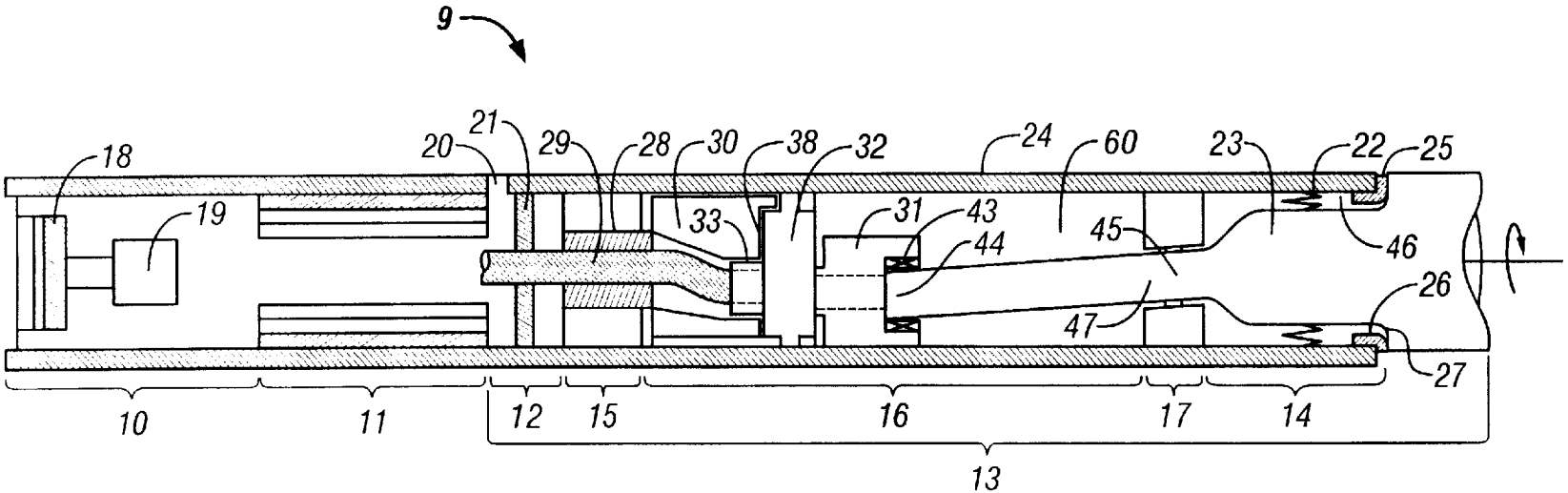
FIG. 2 is a longitudinal sectional view of the rotary steerable drilling tool of FIG. 1 in accordance to the instant invention.

FIG. 2 shows the rotary steerable drilling tool (9) of FIG. 1 in greater detail. The rotary steerable drilling tool (9) includes at least three main sections: a power generation section (10), an electronics and sensor section (11) and a steering section (13).

The power generation section (10) comprises a turbine (18) which drives an alternator (19) to produce electric energy. The turbine and alternator preferably extract mechanical power from the drilling fluid and convert it to electrical power. The turbine preferably is driven by the drilling fluid which travels through the interior of the tool collar down to the drill bit (FIG. 1).

The electronics and sensor section (11) includes directional sensors (magnetometers, accelerometers, and/or gyroscopes, not shown separately) to provide directional control and formation evaluation, among others. The electronics and sensor section (11) may also provide the electronics that are needed to operate the tool.

The steering section (13) includes a pressure compensation section (12), an exterior sealing section (14), a variable bit shaft angulating mechanism (16), a motor assembly (15) used to orient the bit shaft (23) in a desired direction, and the torque transmitting coupling system (17). Preferably, the steering section (13) maintains the bit shaft (23) in a geo-stationary orientation as the collar rotates.

The pressure compensation section (12) comprises at least one conduit (20) opened in the tool collar (24) so that ambient pressure outside of the tool collar can be communicated to the chamber (60) that includes the steering section (13) through a piston (21). The piston (21) equalizes the pressure inside the steering section (13) with the pressure of the drilling fluid that surrounds the tool collar (24).

The exterior sealing section (14) protects the interior of the tool collar (24) from the drilling mud. This section (14) maintains a seal between the oil inside of the steering section (13) and external drilling fluid by providing, at the lower end of the tool collar (24), a bellows seal (22) between the bit shaft (23) and the tool collar (24). The bellows (22) may allow the bit shaft (23) to freely angulate so that the bit can be oriented as needed. In order to make the bellows (22) out of more flexible material, the steering section is compensated to the exterior drilling fluid by the pressure compensation section described above.

A bellows protector ring (25) may also be provided to closes a gap (46) between the bit shaft (23) and the lower end of the tool collar (24). As can be seen in FIG. 2, the bit shaft (23) is preferably conformed to a concave spherical surface (26) at the portion where the tool collar (24) ends. This surface (26) mates with a matching convex surface (27) on the bellows protector ring (25). Both surfaces (26,27) have a center point that is coincident with the center of the torque transmitting coupling (47). As a result, a spherical interface gap (46) is formed that is maintained as the bit shaft (23) angulates. The size of this gap is controlled such that the largest particle of debris that can enter the interface is smaller than the gap between the bellows (22) and bit shaft (23), thereby protecting the bellows from puncture or damage.

The oil in the steering section may be pressure compensated to the annular drilling fluid. As a result, the differential pressure may be minimized across the bellows. This allows the bellows to be made from a thinner material, making it more flexible and minimizing the alternative stresses resulting from the bending during operation to increase the life of the bellow.

The motor assembly (15) operates the variable shaft angulating mechanism (16) which orientates the drill bit shaft (23). The variable bit shaft angulating mechanism (16) comprises the angular motor, an offset mandrel (30), a variable offset coupling (31), and a coupling mechanism (32). The motor assembly is an annular motor that has a tubular rotor (28). Its annular configuration permits all of the steering section components to have larger diameters, and larger load capacities than otherwise possible. The use of an annular motor also increases the torque output and improves cooling as compared with other types of motors. The motor may further be provided with a planetary gearbox and resolver (not shown), preferably with annular designs.

The tubular rotor (28) provides a path for the drilling fluid to flow along the axis of the tool until it reaches the variable bit shaft angulating mechanism (16). Preferably, the drilling fluid flows through a tube (29) that starts at the upper end of the annular motor assembly (15). The tube (29) goes through the annular motor (15) and bends at the variable bit shaft angulating mechanism (16) reaching the drill bit shaft (23) where the drilling fluid is ejected into the drill bit. The presence of the tube (29) avoids the use of dynamic seals to improve reliability.

Alternate embodiments may not include the tube. The drilling fluid enters the upper end of the annular motor assembly, passes through the tubular rotor shaft, passes the variable shaft angle mechanism (16) and reaches the tubular drill bit shaft (23) where the drilling fluid is ejected into the drill bit. This embodiment requires two rotating seals; one where the mud enters the variable shift angle mechanism at the tubular rotor shaft and another one where it leaves it. In this embodiment, the fluid is permitted to flow through the tool.

Angular positioning of the bit relative to the tubular tool collar is performed by the variable bit shaft angulating mechanism (16) shown generally in FIG. 2. The variation in the bit's angular position is obtained by changing the location of the bit shaft's upper end (44) around the corresponding tool collar's cross section, while keeping a point of the bit shaft (45), close to the lower end of the tool collar, fixed.

The bit shaft upper end (44) is attached to the lower end of the variable offset coupling (31). Therefore, any offset of the variable offset coupling (31) will be transferred to the bit. Preferably, the attachment is made through a bearing system (43) that allows it to rotate in the opposite direction with respect to the variable offset coupling's (31) rotation. The offset mandrel (30) is driven by the steering motor to maintain tool-face while drilling, and has an offset bore (33) on its right end.

Figure 3:
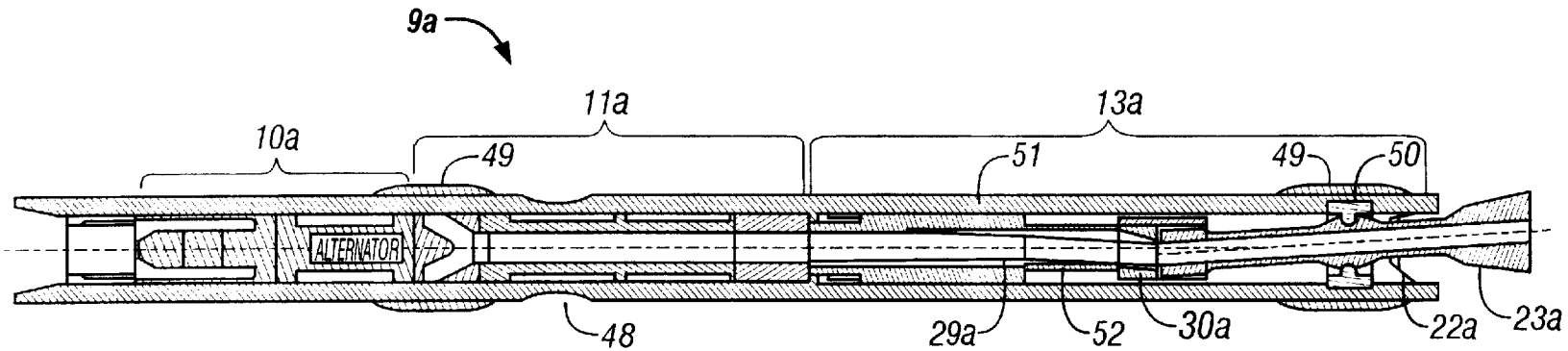
FIG. 3 is a longitudinal sectional view of an alternate embodiment of the rotary steerable drilling tool.

FIG. 3 shows an alternate embodiment of the rotary steerable drilling tool (9*a*) without a variable bit shaft angulating mechanism. The tool (9*a*) of FIG. 3 comprises a power generation section (10*a*), an electronics and sensor section (11*a*), a steering section (13*a*), a bit shaft (23*a*), an offset mandrel (30*a*), a flexible tube (29*a*), a telemetry section (48), bellows (22*a*) and a stabilizer (49). The steering section (13*a*) includes a motor and gear train (51), a geostationary shaft (52) and a universal joint (50).

The torque transmitting coupling system (17) transfers torque from the tool collar (24) to the drill bit shaft (23) and allows the drill bit shaft (23) to be aimed in any desired direction. In other words, the torque transmitting coupling system (17) transfers loads, rotation and/or torque from, for example, the tool collar (24) to the bit shaft (23).

In this embodiment, the bellows (22*a*) are preferably made of a flexible metal and allows for relative motion between the bit shaft and the collar as the bit shaft (23*a*) angulates through a universal joint (50). The tube (29) is preferably flexible and conducts mud through the motor assembly (15), bends where it passes through the other components, and finally attaches to the inside of the bit shaft (23*a*). The preferred embodiment incorporates a flexible tube (29*a*) in the annular design. Alternatively, a rigid design may be used together with additional rotating seals, typically one where the mud would enter the components at the motor rotor and another where it would leave them between the offset mandrel (30*a*) and the bit shaft (23*a*). Preferably, the tube (29*a*) is attached to the up-hole end of the steering section (13*a*) and to the inside of the bit shaft (23*a*), at the lower end. The tube (29*a*) may be unsupported, or may use a support bearing to control the bending of the tube. The tube may be made of a high strength and/or low elastic modulus material, such as high strength titanium alloy.

Figure 4:
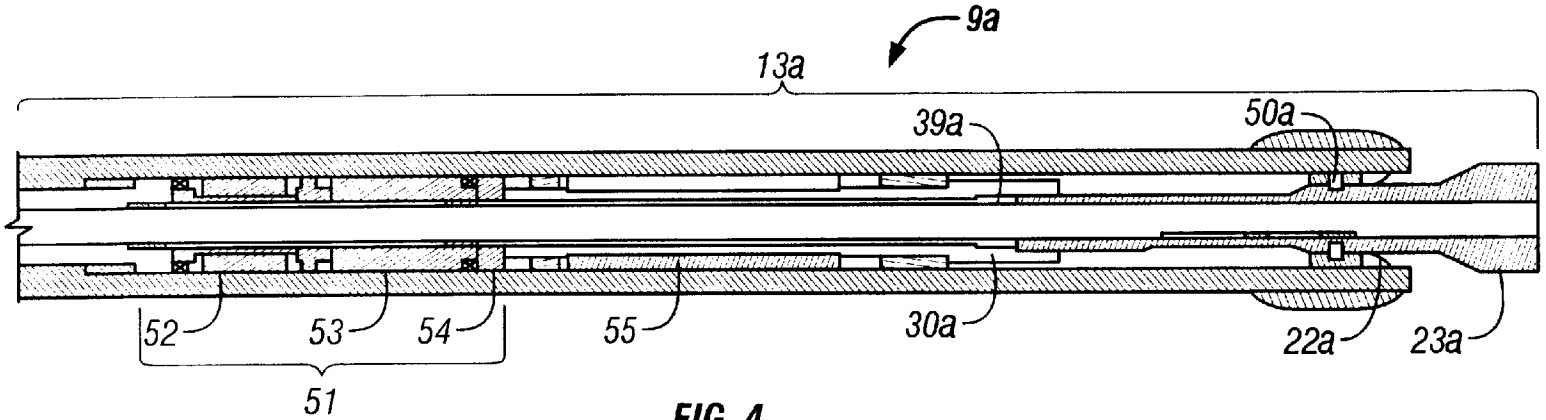
FIG. 4 is a longitudinal sectional view of a portion of the rotary steerable drilling tool of FIG. 3.

FIG. 4 shows a portion of the rotary steerable tool (9*a*) of FIG. 3 and depicts the steering section (13*a*) in greater detail. The steering section (13*a*) includes a motor (52), an annular planetary gear train (53) and a resolver (54). The tool further includes a bit shaft (23*a*), an offsetting mandrel (30*a*) and an eccentric balancing weight (55).

Figure 5:
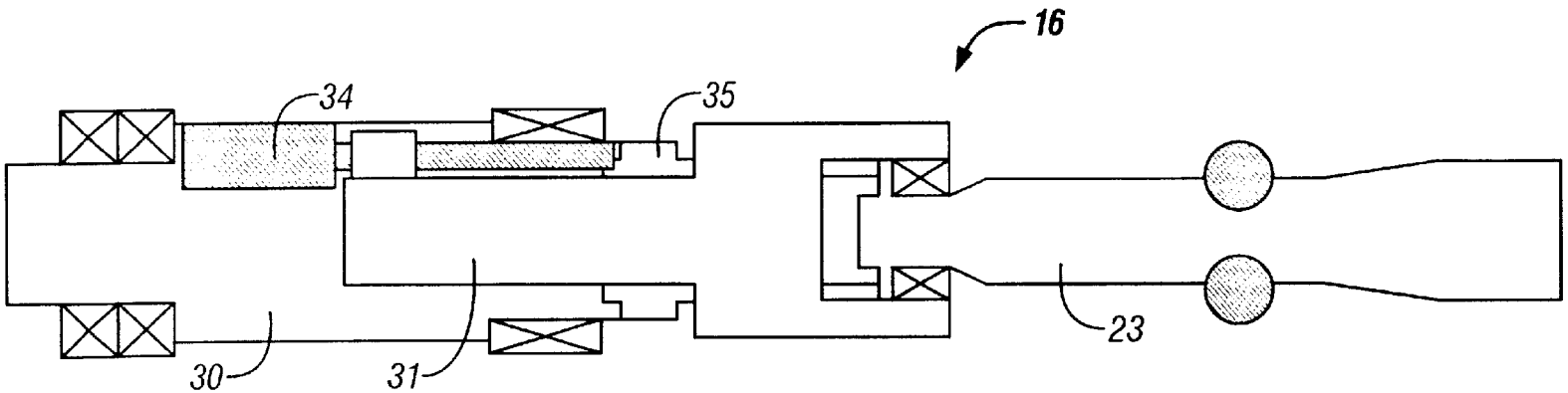
FIG. 5 is a schematic longitudinal sectional view of a portion of the rotary steerable drilling tool of FIG. 2 depicting a variable offset coupling.

Referring now to FIG. 5, shown is a detail of the variable shaft angulating mechanism (16) of the rotary steerable drilling tool (9) of FIG. 2. The variable shaft angulating mechanism (15) depicted in FIG. 5 includes offset mandrel (30), a motor ball screw assembly (34), a locking ring (35) and the variable offset coupling (31) coupled to the bit shaft (23).

The variable offset coupling (31) is held in the offset bore in the offset mandrel (30), and in turn holds the bearings supporting the end of the bit shaft (23) in an offset bore on an end. The offset at the end of the bit shaft results in a proportional offset of the bit. The offset mandrel (30) and the variable offset coupling (31) may be rotated with respect to one another such that the offsets cancel one another, resulting in no bit offset. Alternatively, the offset mandrel (30) and variable offset coupling (31) may be rotated with respect to one another such that the offsets combine to produce the maximum bit offset, or at an intermediate position that would result in an intermediate offset.

The offset mandrel (30) preferably positions the uphole end of the bit shaft (23). The offset mandrel (30) has a bore (33) on its downhole face that is offset with respect to the tool axis. The bore acts as the housing for a bearing that is mounted on the end of the bit shaft. When assembled, the offset bore preferably places the bit shaft at an angle with respect to the axis of the tool.

The motor assembly (FIG. 2) rotates the offset mandrel (30) to position the bit offset as desired. The tool may use a closed loop control system to achieve control of the bit offset as desired. The position of the offset mandrel with respect to gravity is measured continuously by means of a resolver that measures rotation of the offset mandrel with respect to the collar and the accelerometers, magnetometers and/or gyroscopes that measure rotation speed and angular orientation of the collar. Alternatively, the measurement could be made with sensors mounted directly on the offset mandrel (30) itself.

The metal bellows (FIG. 2) provide a seal between the bit shaft (23) and the collar and preferably bend to accommodate the relative motion between them as the bit shaft nutates. The bellows maintains the seal between the oil inside the assembly and the mud outside the tool, and withstand differential pressure as well as full reversal bending as the tool rotates. Finally, the bellows is protected from damage by large debris by a spherical interface that maintains a small gap through which the debris may enter.

The locking ring (35) may also be used to lock the offset mandrel (30) and the variable offset coupling (31) together rotationally as shown in FIG. 5. Preferably, the locking ring (35) rotates with the variable offset coupling (31). While changing angle, the motor/ball screw assembly (34), or another type of linear actuator, pushes the locking ring forward such that it disengages the offset mandrel (30) and engages the bit shaft (23). At that point, rotation of the offset mandrel by means of the steering motor (not shown) will rotate the offset mandrel with respect to the variable offset cylinder, resulting in a change in the offset. When the desired offset is achieved, the locking ring may be retracted, disengaging the variable offset cylinder from the bit shaft and locking it to the offset mandrel once more.

Figure 6:
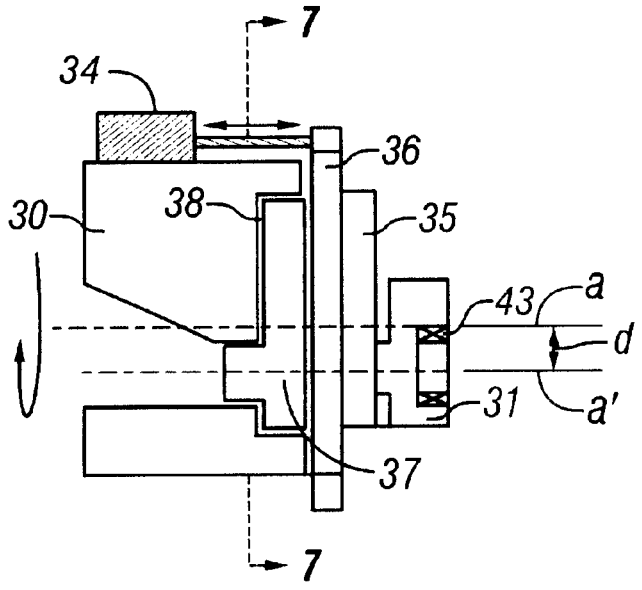
FIG. 6 is a longitudinal view of a portion of the rotary steering tool of FIG. 2 depicting a coupling mechanism.
Figure 7A:
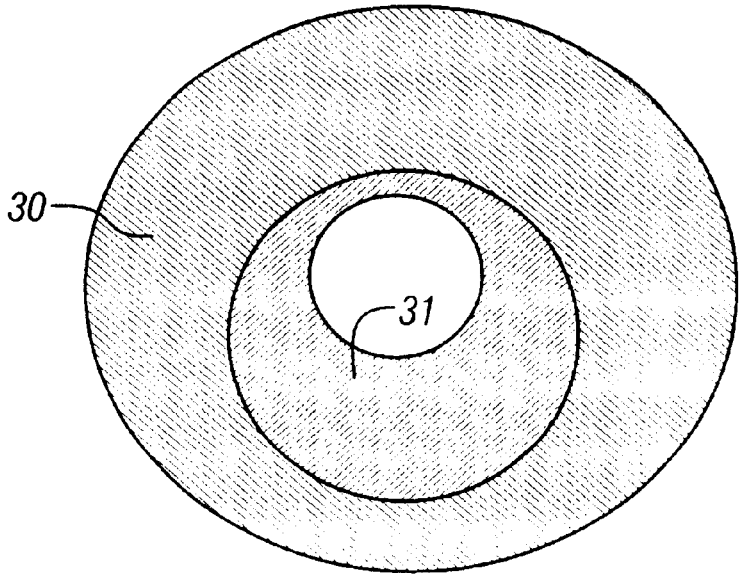
FIGS. 7*a*–7*b* are cross sectional views, along 7–7', of the coupling mechanism of FIG. 6.
Figure 7B:
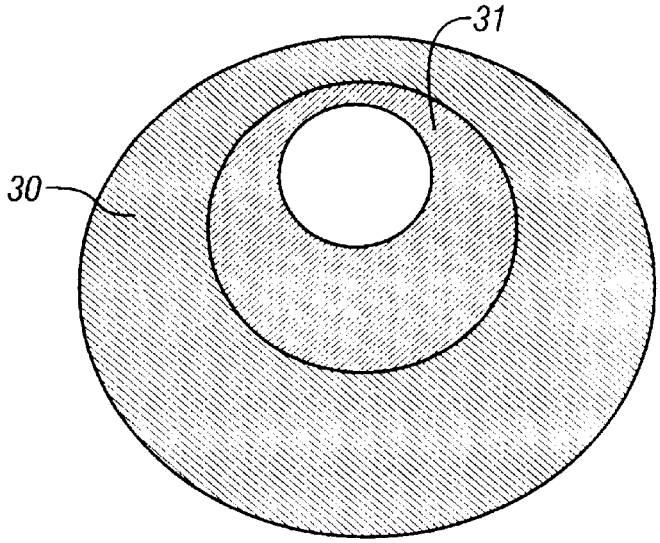

FIGS. 6 and 7 depict the offset mandrel (30) and the variable offset coupling (31). FIGS. 7*a* and 7*b* show a cross-section of the offset mandrel taken along line 7–7' of FIG. 6. The offset mandrel (30) and the offset coupling (31) are attached in such a way that the distance (d) between their longitudinal axes (a–a') can be varied through the rotation of the offset mandrel (30) with respect to the variable offset coupling (31). The case when both axes are collinear corresponds to zero bit offset (FIG. 7*a*). Bit offset will occur when the distance between the axes is different than zero (FIG. 7*b*).

The variable offset coupling (31) is uncoupleably attached to the offset mandrel (30) through a coupling mechanism. Once coupled, the variable offset coupling (31) rotates together with the offset mandrel (30).

In order to change the angle of the bit, the coupling mechanism disengages the variable offset coupling (31) from the offset mandrel. Once uncoupled, the offset mandrel (30) is free to rotate with respect to the variable offset coupling (31) in order to change the distance of the axes (a–a') of the offset mandrel (30) and the variable offset coupling (31), therefore resulting in a change of the bit offset.

The variable bit shaft angulating mechanism (16) comprises an offset mandrel (30) having a non-concentric bore (33), embedded in its lower end cross section. The upper end of the variable offset coupling is held in this bore.

Referring now to FIG. 6, a portion of the rotary steering tool of FIG. 2 depicting a coupling mechanism is shown. The coupling mechanism comprises a linear actuator (34) and a lock ring (35). The lock ring (35) couples the offset mandrel (30) and the variable offset coupling (31) in order that the offset mandrel's (30) rotation is transferred to the variable offset coupling. Coupling is accomplished by embedding the lock ring's (35) inner side (37) in a recess (38) made in the lower end of the offset mandrel (30). In order to uncouple the variable offset coupling (31) from the offset mandrel (30), the actuator (34) pushes the lock ring (35) forward. The coupling of the offset mandrel (30) with the variable offset coupling (31) is obtained by retracing the lock ring (35). Preferably, the actuator (34) acts on an outer ring (36) that extend from the lock ring's (35) edge. The actuator (34) may also be located within the offset mandrel (30) and acts on the interior surface of the lock ring (35). In this case, the actuator (34) would be embedded in the offset mandrel (30). Preferably, the actuator (34) is a linear actuator, such as for example, a motor/ball screw assembly.

In order to change the angle of the bit, the actuator (34) acts on the lock ring (35) such that the offset mandrel (30) is free to rotate with respect to the upper end of the variable offset coupling (31). Preferably, the variable offset coupling (37) is coupled to the bit shaft (23). The angular motor assembly (15) rotates the offset mandrel (30) until the desired bit orientation is achieved, then the variable offset coupling (31) may be again coupled to the offset mandrel (30). Preferably, during the rotation of the offset mandrel (30) the variable offset coupling (31) upper end is kept within the mandrel's non-concentric bore.

The desired bit orientation is obtained by changing the position of bit shaft's upper end (44) as depicted in FIG. 2 above and keeping one point (45) of the bit shaft fixed by the torque transmitting coupling system (17). The torque transmitting coupling system (17) is located at the fixed point of the drill bit shaft (45), opposite to the variable bit shaft angulating mechanism. The torque transmitting coupling system can include any type of torque transmitting coupling that transfers torque from the tool collar (24) to the drill bit shaft (23) even though both of them may not be coaxial.

Figure 8:
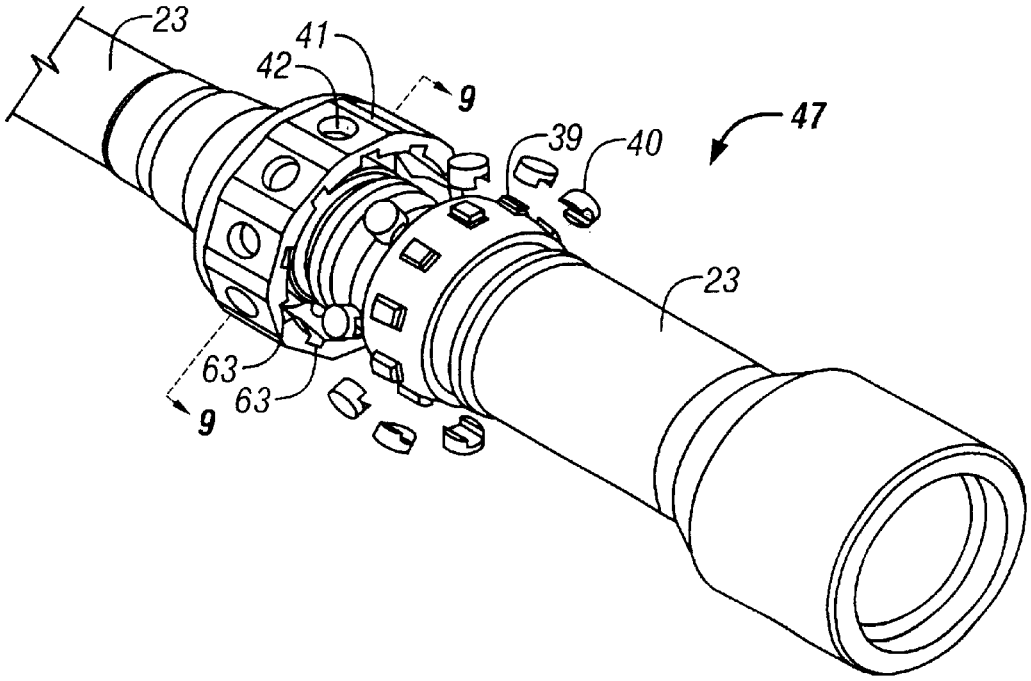
FIG. 8, is a perspective view of a portion of the rotary drilling tool of FIG. 2 depicting a torque transmitting coupling system.

FIG. 8 shows an enlarged view of the torque transmitting coupling (47) of FIG. 2. It comprises protrusions (39) located on the drill bit shaft (23); each protrusion covered by slotted cylinders (40). An exterior ring (41) including on its periphery holes (42) wherein the slotted cylinders (40) fit into the holes (42) in order to lock the protrusions. The corresponding slotted cylinders are free to rotate within each corresponding hole (42) and also allow that the protrusions (39) pivot back and forth.

The torque transmitting coupling (47) shown in FIG. 8 has a total of ten protrusions surrounding the bit shaft. However, other embodiments of the invention can include more or fewer number of protrusions. Preferably, the protrusions (39) maintain surface contact throughout the universal joint as the joint angulates. While balls may be used, as in a standard universal joint, the torque transmission components of the preferred embodiment incorporate slotted cylinders that engage the rectangular protrusions on the drill bit shaft (23). The cylinders (40) preferably allow the protrusions to pivot back and forth in the slots (63).

Figure 9:
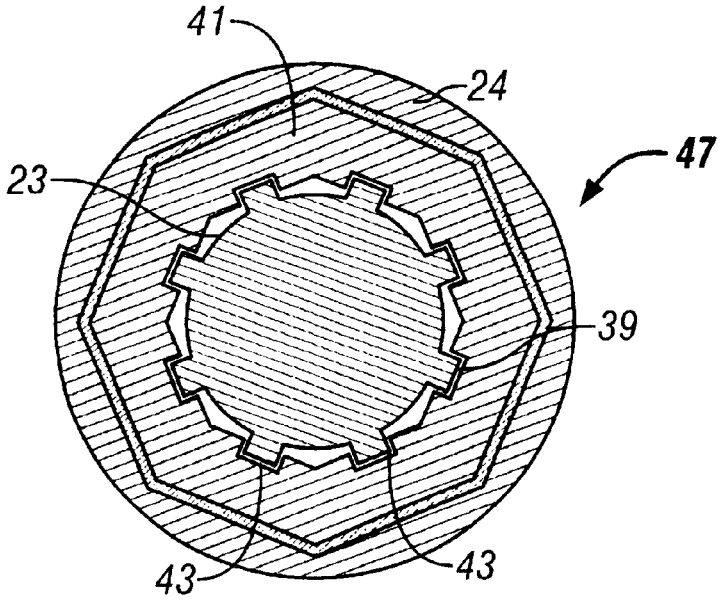
FIG. 9 is a cross sectional view of the torque transmitting coupling system of FIG. 8 taken along line 9–9'.

The outer ring (41) of the torque transmitting coupling (47) is coupled to the inner surface of the tool collar (24) such that it rotates together with the tool collar (24) and transfers the corresponding torque to the drill bit shaft (23). With this configuration, torque is transferred from the protrusions (39) on the drill bit shaft (23) to the cylinders (40), then to the torque ring (41) and to the collar. As shown in FIGS. 8 and 9, torque transmission from the ring to the collar is preferably through a ten-sided polygon. Alternatively, other geometries and/or means of torque transfer known by those of skill in the art may be used.

FIG. 9 shows a cross section of the torque transmitting coupling (47). The cross sections of the exterior surface of the outer ring (41) and the tool collar's interior surface, at least at the portion corresponding to the torque transmitting coupling section (17) are polygons such that they fit one into the other. Accordingly, each side of the tool collar's polygon mates with its counterpart side of the outer ring polygon and transfers the tool collar movement to the drill bit shaft.

Figure 10:
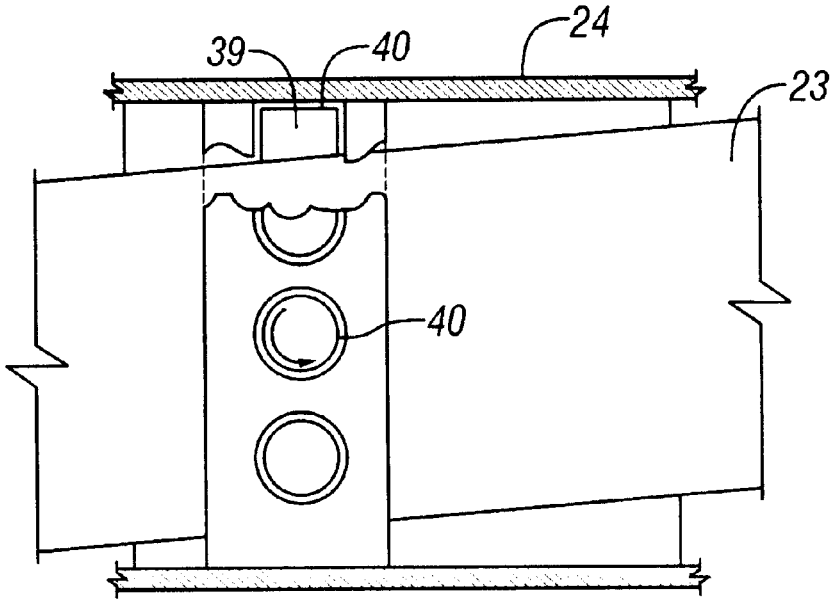
FIG. 10 is a longitudinal partial cross sectional view of the torque transmitting coupling system of FIG. 8.

The protrusions (39) are free to pivot back and forth and the slotted cylinders (40) are free to rotate thereby enabling angulation of the bit shaft. As can be seen in FIG. 10, protrusions located substantially on the same plane as the angulation plane of the bit shaft will move, depending on their position on the bit shaft, back or forth, within the corresponding slotted cylinders. Protrusions that lie substantially on the plane perpendicular to the angulation plane will have no relevant movement, but their corresponding slotted cylinders typically rotate in the direction of angulation.

Figure 11:
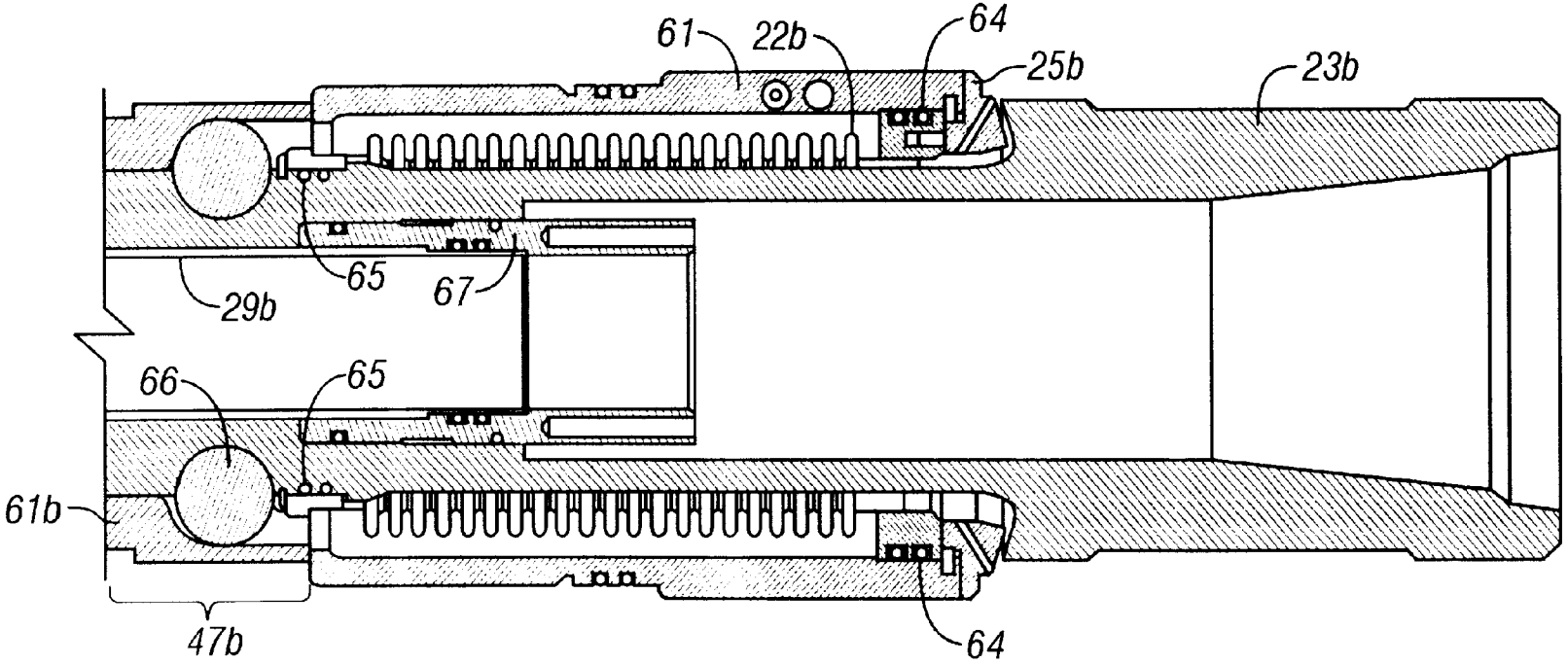
FIG. 11 is a longitudinal cross sectional view of a portion of a rotary steerable drilling tool depicting bellows.

Referring now to FIG. 11, a detailed view of a portion of a rotary steerable drilling tool (9*b*) depicting the bellows (22*b*) is shown. The bellows (22*b*) are positioned on the external jam nut (61) which is threadably coupled to the collar (not shown). A bellows protector ring (25) is positioned between the bit shaft (23*b*) and the external jam nut (61). The bellows (22*b*) is secured along the bit shaft (23*b*) by upper bellow ring (65), and along the jam nut (61) by lower bellow ring (64).

FIG. 11 also shows another embodiment of a torque transmitting coupling (47*b*) including a torque transmitting ball (66) movably positionable between the bit shaft (23*b*) and the torque ring (61*b*). The flexible tube (29*b*) is shown within the bit shaft (23*b*) and connected thereto by an internal jam nut (67).

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A rotary steerable drilling tool, comprising:

a tool collar comprising an interior, an upper end and a lower end, a bit shaft comprising an exterior surface, an upper end and a lower ends the bit shaft being supported within the tool collar for pivotal movement about a fixed position along the bit shaft;

a variable bit shaft angulating mechanism, located within the interior of the tool collar, comprising a motor, an offset mandrel having an upper end and a lower end and a variable offset coupling, having an upper end and a lower end, the motor attached to the upper end of the offset mandrel and adapted to rotate the offset mandrel, the upper end of variable offset coupling being uncoupleably attached to an offset location of the lower end of the offset mandrel, and the upper end of the bit shaft being rotatably coupled to the variable offset coupling;

a torque transmitting coupling adapted to transmit torque from the tool collar to the bit shaft at the fixed position along the bit shaft; and a seal system adapted to seal between the lower end of the collar and the bit shaft.

2. The rotary steerable drilling tool according to claim 1, farther comprising a lock ring adapted to uncoupleably attach the variable offset coupling to the offset location of the offset mandrel.

3. The rotary steerable drilling tool according to claim 2 further comprising an actuator adapted to uncouple the offset mandrel from the variable offset coupling.

4. The rotary steerable drilling tool according to claim 3 wherein the lock ring comprises an outer ring on which the actuator acts.

5. The rotary steerable drilling tool according to claim 4 wherein the actuator comprises a linear actuator.

6. The rotary steerable drilling tool according to claim 5 wherein the linear actuator comprises a motor/ball screw assembly.

7. The rotary steerable drilling tool according to claim 6 wherein the motor is an annular motor.

8. The rotary steerable drilling tool according to claim 1, the bit shaft, at the fixed point, comprising a plurality of protrusions extending radially from the exterior surface of the drill bit shaft, wherein the torque transmitting coupling comprises, a ring having an inner surface and a perimeter and a plurality of perforations around the perimeter, wherein the ring surrounds the bit shaft and each protrusion is aligned with a perforation of the ring;

a plurality of cylinders comprising lower ends, each lower end having a slot; wherein the cylinders are located within the perforations of the ring and the protrusions enter the slot, of the cylinder.

9. The rotary steerable drilling tool according to claim 8 wherein the inner surface of the ring comprises plurality of slots each slot intersecting a perforation of the ring.

10. The rotary steerable drilling tool according to claim 9 wherein the ring is fixed to the inner surface of the tool collar.

11. The rotary steerable drilling tool according to claim 10 the ring and the inner surface of the tool collar having cross sections wherein the cross sections are polygons.

12. The rotary steerable drilling toot according to claim 1, wherein the seal system comprises;

a bellows seal located between the tool collar and the drill bit shaft, a ring located between the tool collar and the drill bit shaft and located at the lower end of the tool collar, the ring having an upper end and a lower end.

13. The rotary steerable drilling tool according to claim 12 wherein a pressure between the interior of the tool collar and fluid pressure in a well is equalized by a pressure compensation system comprising a conduit passing through the tool collar and a slidable piston being located within the tool collar, having an upper and lower side wherein the upper side of the piston is exposed to the fluid pressure of the well.

14. The rotary steerable chilling tool according to claim 13 wherein the ring is adapted to substantially close a gap between the bit shaft and the lower end of the tool collar.

15. The rotary steerable drilling tool according to claim 14 wherein the drill bit shaft exterior surface, at a location where the drill bit shaft exits the tool collar, has a concave spherical surface.

16. The rotary steerable drilling tool according to claim 15 wherein the upper end of the ring has a convex spherical surface adapted to mate with the concave spherical surface of the drill bit shaft.

17. The rotary steerable drilling tool according to claim 1 wherein the motor is an annular motor.

18. The rotary steerable drilling tool according to claim 17 further comprising a tube adapted to conduct drilling fluid from an upper end of the motor to the upper end of the drill bit shaft.

19. The rotary steerable drilling tool according to claim 18 wherein the tube comprises a titanium alloy.

20. A variable bit shaft angulating mechanism comprising:

a motor, an offset mandrel comprising an upper end and a lower end, the motor attached at the upper end of the offset mandrel and adapted to rotate the offset mandrel, a variable offset coupling mechanism comprising an upper end and a lower end; and a lock ring, wherein the lock ring is adapted to uncoupleably attach the upper end of the variable offset coupling at an offset location of the lower end of the offset mandrel.

21. The variable bit shaft angulating mechanism according to claim 20 further comprising an actuator adapted to uncouple the offset mandrel from the variable offset coupling.

22. The variable bit shaft angulating mechanism according to claim 21 wherein the lock ring comprises an outer ring on which the actuator acts.

23. The variable bit shaft angulating mechanism according to claim 22 wherein the actuator comprises a linear actuator.

24. The variable bit shaft angulating mechanism according to claim 23, wherein the liner actuator comprises a motor/ball screw.

25. A torque transmitting coupling comprising:

a first shaft comprising a periphery;

protrusions extending from the periphery of the first shaft;

a second shaft comprising a inner surface and a ring, the ring having an inner surface and a plurality of perforations around its perimeter and surrounding the first shaft, each protrusion being aligned with one perforation of the ring; and a plurality of cylinders each comprising a lower end, each lower end having a slot; wherein the plurality of cylinders are located within the plurality of perforations of the ring and the protrusions enter the slot of the lower end of each of the plurality of cylinders.

26. The torque transmitting coupling according to claim 25 wherein the inner surface of the ring comprises a plurality of slots that intersect the perforations of the ring.

27. The torque transmitting coupling according to claim 26 wherein at least a portion of the first shaft is enclosed by the second shaft.

28. The torque transmitting coupling according to claim 27 wherein the ring is fixed within the second shaft.

29. The torque transmitting coupling according to claim 28 wherein the ring and the second shaft have a polygonal cross section.

30. A rotary steerable drilling tool comprising:

a tool collar comprising an interior, an upper end and a lower end;

a bit shaft comprising an exterior surface, an upper end and a lower end, the bit shaft being supported within the tool collar for pivotal movement about a fixed position along the bit shaft;

a variable bit shaft angulating mechanism, comprising:

a motor;

an offset mandrel comprising an upper end and a lower end, the motor attached at the upper end of the offset mandrel and adapted to rotate the offset mandrel;

a variable offset coupling mechanism comprising an upper end and a lower end, and a lock ring;

wherein the lock ring is adapted to uncoupleably attach the upper end of the variable offset coupling at an offset location of the lower end of the offset mandrel;

a torque transmitting coupling adapted to transmit torque from the tool collar to the bit shaft at the fixed position along the bit shaft; and a seal system adapted to seal between the lower end of the collar and the bit shaft.

31. A rotary steerable drilling tool comprising:

a tool collar comprising an interior, an upper end and a lower end;

a bit shaft comprising an exterior surface, an upper end and a lower end, the bit shaft being supported within the tool collar for pivotal movement about a fixed position along the bit shaft;

a variable bit shaft angulating mechanism, located within the interior of the tool collar, comprising a motor, an offset mandrel having an upper end and a lower end and a variable offset coupling, having an upper end and a lower end, the motor attached to the upper end of the offset mandrel and adapted to rotate the offset mandrel, the upper end of variable offset coupling being uncoupleably attached to an offset location of the lower end of the offset mandrel, and the upper end of the bit shaft being rotatably coupled to the variable offset coupling;

a torque transmitting coupling comprising:

a first shaft comprising a periphery;

protrusions extending from the periphery of the first shaft;

a second shaft comprising a inner surface and a ring, the ring having an inner surface and a plurality of perforations around its perimeter and surrounding the first shaft, each protrusion being aligned with one perforation of the ring;

a plurality of cylinders each comprising a lower end, the each lower end having a slot; wherein the plurality of cylinders are located within the plurality of perforations of the ring and the protrusions enter the slot in the lower end of each of the plurality of cylinders; and a seal system adapted to seal between the lower end of the collar and the bit shaft.

* * * * *